United States Patent [19]

Mitchell et al.

[11] 4,222,075

[45] Sep. 9, 1980

[54] IMPLOSION-RESISTANT CATHODE RAY TUBE STRUCTURE AND FABRICATION PROCESS

[75] Inventors: Robert B. Mitchell, Seneca Falls; Harry R. Swank, Waterloo, both of N.Y.

[73] Assignee: GTE Products Corporation, Stamford, Conn.

[21] Appl. No.: 941,623

[22] Filed: Sep. 12, 1978

[51] Int. Cl.[3] ..... H04N 5/65

[52] U.S. Cl. ..... 358/246; 220/2.1 A

[58] Field of Search ..... 358/245, 246, 247, 248, 358/249; 220/2.1 A, 2.3 A; 29/25.13

[56] References Cited

U.S. PATENT DOCUMENTS

| | | | |
|---|---|---|---|
| 3,317,172 | 5/1967 | Balint | 358/246 |
| 4,080,631 | 3/1978 | Puhak | 358/246 |

*Primary Examiner*—Robert L. Griffin
*Assistant Examiner*—Joseph A. Orsino, Jr.
*Attorney, Agent, or Firm*—Thomas H. Buffton

[57] ABSTRACT

An implosion-resistant cathode ray tube has an evacuated envelope with a face panel having a substantially rectangular-shaped viewing portion extending to an upturned flanged portion with corners having a given radius of curvature and a metal band encircling and exerting a compressive force on the upturned flanged portion and an "L"-shaped bracket member with a base portion connected to an upstanding attachment portion has the base portion positioned intermediate the metal band and the corner of the envelope and is of a width to provide contact of the encircling metal band with the envelope corner on the given radius of curvature. The implosion-resistant cathode ray tube is fabricated by a process wherein an envelope having a rectangular-shaped viewing portion with corners of a given radius of curvature is selected, encircled by a metal band, and an "L"-shaped bracket member having a base portion of a width to provide contact of the metal band on the given radius of curvature of the envelope corner is disposed intermediate the metal band and the envelope corner.

6 Claims, 4 Drawing Figures

FIG. 1
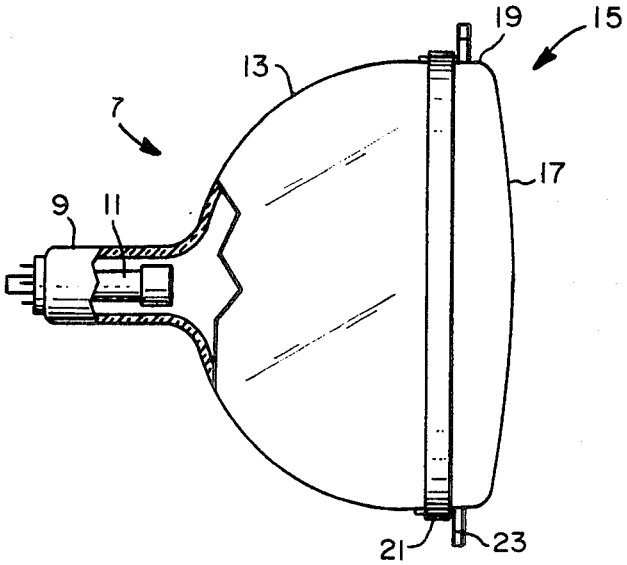
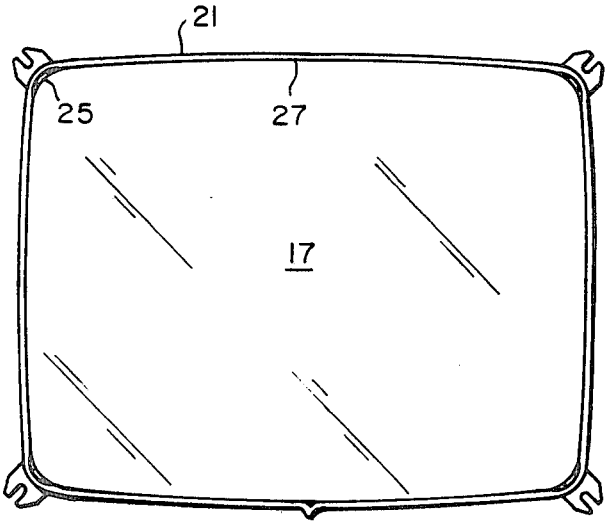
FIG. 2
FIG. 3
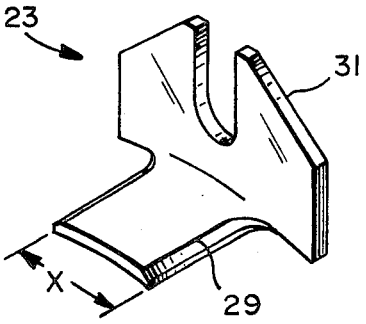

IMPLOSION-RESISTANT CATHODE RAY TUBE STRUCTURE AND FABRICATION PROCESS

CROSS REFERENCE TO OTHER APPLICATIONS

A concurrently filed application entitled "L"-shaped Bracket Assembly and "Rimband Type Implosion-Resistant Cathode Ray Tube", bearing U.S. Ser. No. 941,622 in the names of the present inventors and assigned to the same Assignee relates to an improved structure having a rimband and affixed ear members.

TECHNICAL FIELD

This invention relates to cathode ray tubes and more particularly to an implosion-resistant cathode ray tube structure and fabrication process.

BACKGROUND OF THE INVENTION

In the area of implosion-resistant cathode ray tube structures and processes, it is known to provide substantially "L"-shaped bracket members having a base portion and an upstanding attachment portion affixed thereto, which has a hole or slot to fit over a bolt. In those known structures, it is a common practice to affix the base portion of the bracket member to a rimband and to encircle the rimband and the base portion of the bracket member with a metal band exerting a compressive force thereon. Thus, the compressive force exerted by the metal band tends to inhibit undesired implosion and flying particles upon rupture of the evacuated envelope of a cathode ray tube.

In present-day cathode ray tube structures, the viewing portion of the evacuated envelope is substantially rectangular-shaped and extends to a flanged upstanding portion whereon the rimband, bracket member, and metal band are positioned. Also, this substantially rectangular-shaped envelope has corners with a given radius of curvature whereon the bracket members are positionally located. Moreover, these corners with the given radius of curvature blend into a substantially flattened portion of the envelope extending intermediate the corners and having a vastly different radius of curvature.

In all of the known structures, the base portion of the bracket member is of a width such that the metal band providing the compressive force and encircling the base portion does not contact the radius of curvature of the envelope corner. Rather, the width of the base portion of the bracket member is such that the encircling metal band contacts the flattened portion of the envelope intermediate the corners.

However, it has been found that the jointure of the radius of curvature of the corner and of the flattened portion of the evacuated envelope is a particularly critical area with regard to rupture susceptibility. Thus, a bracket member having a base portion of a width such that the encircling metal band contacts the radius of curvature of the corner rather than the flattened portion of the evacuated envelope enhances the implosion-resistant capabilities of the structures.

SUMMARY OF THE INVENTION

In one aspect of the invention, an implosion-resistant cathode ray tube has an evacuated envelope with a face panel having a substantially rectangular-shaped viewing portion extending into an upturned flanged portion with corners having a given radius of curvature. A metal band encircles the upturned flanged portion and exerts a compressive force thereon while an "L"-shaped bracket member having a base portion connected to an upstanding attachment portion has the base portion positioned intermediate the encircling metal band and the corner of the face panel. The base portion of the bracket member is of a width such that the encircling metal band contacts the given radius of curvature of the corner of the face panel whereby implosion-resistance of the structure is enhanced.

Also, the implosion-resistant cathode ray tube is fabricated by a process which includes selecting an evacuated envelope having a rectangular-shaped face panel extending to a flanged portion having corners with a given radius of curvature, encircling the flanged portion with a metal band exerting a compressive face thereon, and locating the base portion of an "L"-shaped bracket member intermediate the metal band and the corner of the face panel with the base portion of the bracket member of a width such that the metal band contacts the radius of curvature of the corner of the evacuated envelope.

BRIEF DESCRIPTION OF THE DRAWINGS

FIG. 1 is a cut-away view of a typical cathode ray tube with implosion-resistant capabilities;

FIG. 2 is a front elevational view illustrating the viewing portion of a cathode ray tube with affixed "L"-shaped bracket members;

FIG. 3 illustrates a preferred form of "L"-shaped bracket member; and

PREFERRED EMBODIMENT OF THE INVENTION

Figure 4:
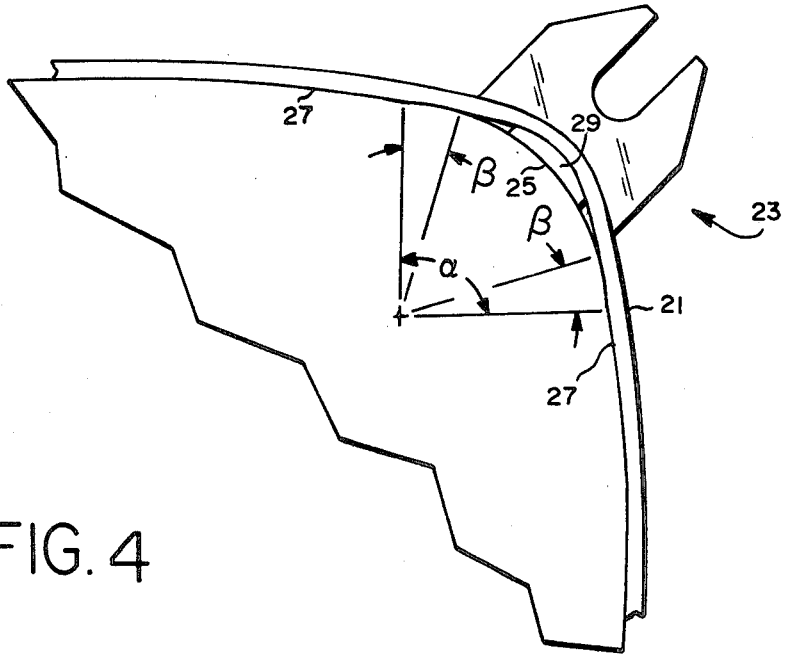
FIG. 4 is an enlarged partial front elevational view illustrating a preferred embodiment of the invention.

For a better understanding of the present invention, together with other and further objects, advantages and capabilities thereof, reference is made to the following disclosure and appended claims in connection with the accompanying drawings.

Referring to FIG. 1 of the drawings, an implosion-resistant cathode ray tube includes an evacuated envelope 7 having a neck portion 9 wherein is sealed an electron gun assembly 11 and which extends to a flared portion 13. A face panel 15 includes a substantially rectangular-shaped viewing portion 17 which extends to an upturned flanged portion 19. The upturned flanged portion 19 is affixed to the flared portion 13, as by frit sealing for example, and a metal band 21 encircles and exerts a compressive force on the upturned flanged portion 19 of the face panel 15. Also, a substantially "L"-shaped bracket member 23 is disposed intermediate the metal band 21 and the upturned flanged portion 19 of the face panel 15.

Referring to FIG. 2, the viewing portion 17 of the face panel 15 is substantially rectangular-shaped with corner portions 25 and substantially flattened portions 27 intermediate the corner portions 25. The metal band 21 encircles the viewing portion 17 and a bracket member 23 of a substantially "L"-shaped configuration is disposed intermediate the metal band 21 and the corner portion 25 on at least one and preferably all of the corner portions 25.

More specifically, the substantially "L"-shaped bracket member 23 illustrated in FIG. 3, includes a base portion 29 connected to an upstanding attachment portion 31. The base portion 29 is disposed intermediate the metal band 21 and the corner portion 25 of FIG. 2 and is of a size to enhance contact of the metal band 21 and the radius of curvature of the corner portion 25 as will be explained hereinafter. Preferably, the base portion 29 of the bracket member 23 is of a width "X" in the range of about 0.35 to 0.65 inch for cathode ray tubes with a viewing portion 17 having a diagonal measurement in the range of about 13 to 25-inches.

Referring to the enlarged front elevational view of FIG. 4, the corner portion 25 has a given radius of curvature which is formed by an angle "$\alpha$" preferably in the range of about 78 to 85 degrees. This given radius of curvature of the corner portion 25 blends into a substantially flattened portion 27. However, the base portion 29 of the bracket member 23 is of a size such that the encircling metal band 21 contacts the given radius of curvature of the corner portion 25 prior to reaching the flattened portion 27. Preferably, the encircling metal band 21 contacts the given radius of curvature of the corner portion 25 at an angle "$\beta$" in the range of about 5 to 15 degrees before reaching the point whereat the radius of curvature of the corner portion 25 blends with the flattened portion 27.

In fabricating the above-mentioned implosion-resistant cathode ray tube, an evacuated envelope is selected which has a face panel with a substantially rectangular shaped viewing portion which blends into an upturned flanged portion with corners having a given radius of curvature. The upturned flanged portion of the envelope is encircled with a metal band which exerts a compressive force thereon. Also, a substantially "L"-shaped bracket member has a base portion which is disposed intermediate the metal band and at least one corner portion of the envelope. This base portion is of a size to permit the encircling metal band to contact the radius of curvature of the corner portion of the envelope.

INDUSTRIAL APPLICABILITY

Thus, there has been provided a unique structure and process for fabricating an enhanced implosion-resistant cathode ray tube suitable for use in a television receiver. The structure provides an increased implosion-resistant capability at a minimum increase in labor and material cost.

While there has been shown and described what is at present considered the preferred embodiment of the invention, it will be obvious to those skilled in the art that various changes and modifications may be made therein without departing from the invention as defined by the appended claims.

We claim:

1. In an implosion-resistant cathode ray tube having an evacuated envelope with a face panel sealed to a flared neck portion wherein said flared neck portion has an electron gun assembly sealed therein and said face panel has a substantially rectangular-shaped viewing portion extending to an upturned flanged portion with corners having a given radius of curvature which blend into relatively flattened portions of said upturned flanged portion and a metal band encircling the upturned flanged portion of the face panel and exerting a compressive force thereon, the improvement comprising at least one substantially "L"-shaped bracket member having a base portion connected to an upstanding attachment portion with the base portion positioned intermediate said metal band and said corner of said upturned flanged portion of said face panel and of a size to provide contact of said encircling metal band and said upturned flanged portion of said face panel on said given radius of curvature of said corner intermediate said base portion of said bracket member and said relatively flattened portions of said upturned flanged portion of said face panel.

2. In the implosion-resistant cathode ray tube of claim 1, the improvement wherein said face panel includes four corners each having a given radius of curvature blending into relatively flattened portions and an "L"-shaped bracket member with a base portion positioned intermediate said metal band and each of said corners and of a size to provide contact of said metal band and said face panel on said given radius of curvature of said envelope corners intermediate said base portion of said bracket members and said relatively flattened portions of said face panel.

3. In the implosion-resistant cathode ray tube of claim 1, the improvement wherein said corners of said face panel have a radius of curvature formed by an angle in the range of about 78 to 85 degrees and said base portion of said "L"-shaped bracket member is of a size to provide contact of said encircling metal band and said face panel on said radius of curvature of said envelope corners intermediate said bracket member and said relatively flattened portions of said face panel.

4. In the implosion-resistant cathode ray tube of claim 1, the improvement wherein said base portion of said "L"-shaped bracket member is of a width in the range of about 0.35 to 0.65 inch.

5. In the implosion-resistant cathode ray tube of claim 1, the improvement wherein said corners of said face panel have a given radius of curvature and said base portion of said "L"-shaped bracket member is of a size to provide contact of said encircling metal band and said given radius of curvature at an angle in the range of about 5 to 15 degrees prior to the extremities of said given radius of curvature.

6. In a process for fabricating an implosion-resistant cathode ray tube including the steps of selecting an evacuated envelope having a face panel sealed to a flared neck portion with said neck portion containing an electron gun assembly and said face panel having a substantially rectangular-shaped viewing portion extending to an upturned flange portion with corners having a given radius of curvature blending into relatively flattened portions of said upturned flanged portion and encircling said flanged portion of said face panel with a metal band exerting a compressive force thereon, the improvement comprising the step of locating an "L"-shaped bracket member on at least one of said corners of said face panel with said bracket member having a base portion positioned intermediate said metal band and said corner and of a size to provide contact of said encircling metal band and said given radius of curvature of said envelope corner intermediate said bracket member and said relatively flattened portions of said face panel.

* * * * *